US005588261A

United States Patent [19]

MacConochie

[11] Patent Number: 5,588,261

[45] Date of Patent: Dec. 31, 1996

[54] DISCRIMINATOR RAIN GUTTER SYSTEM

[76] Inventor: Ian O. MacConochie, 300 Old Landing Rd., Yorktown, Va. 23692

[21] Appl. No.: 265,127

[22] Filed: Jun. 24, 1994

[51] Int. Cl.[6] ..... E04D 13/00

[52] U.S. Cl. ..... 52/11; 52/12; 52/16

[58] Field of Search ..... 52/11, 12, 16

[56] References Cited

U.S. PATENT DOCUMENTS

| | | | |
|---|---|---|---|
| 603,611 | 5/1898 | Nye | 52/11 |
| 2,669,950 | 2/1954 | Bartholomew | 52/12 |
| 2,873,700 | 2/1959 | Heier | 52/12 |
| 4,406,093 | 9/1983 | Good et al. | 52/11 |
| 4,493,588 | 1/1985 | Duffy | 52/12 X |
| 4,497,146 | 2/1985 | Demartini | 52/11 X |
| 4,951,430 | 8/1990 | Gottlieb | 52/11 |
| 5,016,404 | 5/1991 | Briggs | 52/11 X |
| 5,332,332 | 7/1994 | Kenyon, Jr. | 52/11 X |

FOREIGN PATENT DOCUMENTS

| | | | |
|---|---|---|---|
| 14503 | 6/1914 | United Kingdom | 52/11 |

*Primary Examiner*—Christopher Todd Kent

[57] ABSTRACT

A non-clogging gutter system comprised of two components: A half cylinder with flanges whose principal axis is orientated parallel to the edge of an inclined roof and is fastened to the vertical plane of the eaves and a gutter located just below the half cylinder, also mounted on the vertical plane of the eaves, but whose outer edge is recessed compared to the half cylinder. In operation, rainwater hydraulically flows down the inclined roof and onto the half cylinder where large debris, relatively unimpeded, is discharged to the ground, while the rainwater and macroscopic particles, by virtue of their higher molecular attraction compared to mass, adhere to the half cylinder finally discharging into the gutter because of the more normal orientation of the gravity vector compared to the half cylinder's surface. The gutter is shaped so that its cross sectional area increases exponentially from bottom-to-top so that, even in light rains, the flow velocity will be relatively high, reducing dwell-time of rainwater in the gutter and thence reducing the amount of settling of macroscopic particles such as shingle grits, seeds, and pollen.

5 Claims, 4 Drawing Sheets

DISCRIMINATOR RAIN GUTTER SYSTEM

BACKGROUND OF THE INVENTION

1. Field of the Invention

This invention relates generally to rain gutters used on buildings having inclined roofs. In particular, to a rain gutter system that captures rain water run-off from the roof while rejecting the debris, such as leaves, pine needles, and sticks to the ground.

2. Description of Related Art

In the prior art, a gutter in the form of an open trough is used to capture the run-off from an inclined roof and divert it to down spouts. These gutters are typically about 3 inches wide and of about equal height, have a flat bottom, and are rolled ornamentally in the front. The larger debris, such as sticks, leaves, and pine needles are trapped in the gutter. The accumulation of the larger debris tends to block the flow of water at numerous locations creating settling basins for the capture of smaller particles such as decorative grit from shingles and seeds from trees; particles that would normally have been transported to ground drains in a reasonably high flow field. Gutters of conventional design and located in wooded areas eventually clog and overflow unless cleaned frequently.

Several solutions have been offered to prevent debris; from falling into, and blocking the flow in the gutter. Covers include plastic or metallic mesh, and solid plates that are slotted or perforated. These plates, or mesh, can be retro-fitted to most gutters typically used but do not prevent the pile-up of debris. Certain forms of debris, such as pine needles, tend to lodge in the apertures of the screen or perforated covers creating an untidy appearance and presenting the user with a tedious job for removal.

In a second family of designs, various solid-curved plates are placed over the gutter. The principle employed in these designs is that water has a greater adherence to the smooth-curved cover than debris, such that the water will flow around, and under, the cover and enter the gutter, while the debris, unable to follow the surface, will fall to the ground. One example of a solid cover is a design referred to as Gutter Helmet (or Gutta-Gard). The cover, flat over most of the open section of the gutter being covered, is configured with the outside edge rolled under on about a ½ inch radius. The cover rests on stand-offs mounted on the outside edge of the gutter making an aperture, in the form of a slot, between rolled edge of cover and the outside edge of the gutter just beneath it. The rear edge of the cover is inserted beneath a row of shingles in proximity of the edge of the roof. Pitches of from zero to approximately 15 degrees are employed for these covers with rolled outer edges. Commonly used roof pitches are 26.6 degrees(6×12) and 45 degrees(12×12). These solid covers with rolled outer edge can be retro-fitted to most gutters now in use.

Another example of a solid-cover design is the Leafguard Seamless Gutter System"(U.S. Pat. No. 4,757,649.) The design is similar to that just described except that the solid cover is an integral part of the gutter. The gutter portion of the seamless cross-section is approximately 3 inches wide. Installation involves removal of present gutters. Retention of existing downspouts is possible.

U.S. patent (U.S. Pat. Nos. 4,493,588 and 5,016,404) operate on a similar principle to the above, namely that of a curved surface to which water adheres while debris is rejected to ground level. One design (U.S. Pat. No. 5,016,404) is compatible with conventional gutter cross-sections but with non-conventional gutter installations, it being necessary to lower the gutter in order to accommodate brackets and a curved section of sheet material that encompasses the fascia board. In this design the conventional gutter is installed beneath the curved section below soffit level instead of on the face of the fascia board. The uppermost edge of the curved section is inserted beneath one of the lower rows of shingles at the roof's edge.

The design of U.S. Pat. No. 4,493,588 by Duffy resembles that of the later designs, U.S. Pat. No. 5,016,404 by Briggs except that the curved portion of the design appears to generally extend over twice the vertical height of the fascia having a bracket that extends from the bottom edge of the curved section upwards to the bottom of the soffit board. The gutter, located beneath the curved section, is dimensionally similar to conventional gutters being about 3 inches wide. A grill is added in the aperture between the curved portion and the outside edge of the gutter which the claimant includes to prevent debris from entering the gutter.

The disadvantage of the prior art, as represented by conventional gutter without a cover, is that the gutter is a nearly perfect trap for any debris carried to the edge of the roof by the flow of water; the conventional open gutter mechanically traps nearly 100 percent of debris making it necessary to manually remove this debris frequently in order to preserve functionality of the conventional gutter system.

All conventional gutters and those cited in the recent U.S. Pat. Nos. 4,493,588, 4,757,6495, and 5,016,404 trap most of the debris in the form of small particles via the principle of settling. This type of debris includes seeds from trees, pollen, and decorative grits from shingles. The technique of settling is an art well understood and, in its simplest terms involves the reduction in flow rates of the fluid in which particles of greater density than the fluid are suspended. By reducing the flow rates, the particles of greater density are given time to settle out. Conventional gutters, and those utilized in conjunction with the various covers described above, qualify in this way; featuring relatively low fluid velocity flows due to the use of relatively large-wide-flat bottom sections for the gutter. The patents of Briggs(U.S. Pat. No. 5,016,404), Duffy(U.S. Pat. No. 4,493,588), Demartini(U.S. Pat. No. 4,497,146), Bartholomew(U.S. Pat. No. 2,669,332), and Kenyon(U.S. Pat. No. 5,332,332) all require insertion of an upper flange underneath the roof cover; and in most cases fastening to attach the system to the inclined roof. All designs are at risk for causing damage to existing or new roof shingles.

The principal disadvantage of covers as depicted by Helmet Guard and Leafguard(U.S. Pat. No. 4,757,649)is that the nearly-flat portion of the covers represents a shelf having a much lower pitch than the roof to which the system is attached. The principles that govern the successful, or unsuccessful, discharge of debris from the roof include the surface roughness of the roof and gutter covers, the inclinations of the roof and cover, the angle of repose of the debris, and the molecular attraction of the debris to the surfaces. It should be obvious, even to those not skilled in the art; that, for any given surface, any reduction in the inclination angle, that the surfaces makes with the horizontal, will yield a corresponding increase in debris retention. The pile-up of debris on the covers oriented at low angles to the horizontal eventually causing water to back-flow under shingles, or behind the fascia boards, to which the gutters are attached. Covers of much lower pitch than the inclined roof to which they are installed are particularly evident in the designs of Demartini(U.S. Pat. No. 4,497,146) and Heier (U.S. Pat. No. 2,873,700).

In addition to a pile-up of debris, experience has shown that horizontal slotted or screen gutter covers afford a potential trap for pine needles; the pine needles lodging in the vertical or near vertical end-wise in the slots, or appertures in the screens. This applies also to vertical screens such as that shown by Duffy in U.S. Pat. No. 4,493,588 in which a vertical screen (or nearly vertical screen) is used to block the flow of larger debris into the space between the curved cover and gutter. Debris, such as pine needles, lodging even in a vertical screen, are unsightly and labor-intensive to remove. The solid cover (Ref. Gutter Helmet) although smooth, is subject to debris build-up because of the characteristically low pitch compared to the roof from which water effluents are to be captured while debris is to be ejected.

A disadvantage of all designs is that each characteristically utilizes the wide-bottom gutter of conventional gutters that act as a settling basin for the flow rates typical of light rainfalls. This debris, in the form of particulates, such as grit or seeds and having a large surface-area-to-mass compared to sticks (for example) will follow the contour flow of water adhering to the underside of the curved section and discharging into the gutter which serves as a settling basin because of the low ratio of water mass flow rate compared to gutter width. Good in U.S. Pat. No. 4,406,093 shows a liner in a gutter that can be manually extracted from the gutter to periodically extract debris. Any large debris, such as a pine cone, acts as an obstruction to flow; and the higher the frequency of the debris, the greater the number of the discrete settling basins located serially along the gutter. The gutter of Good et al. U.S. Pat. No. 4,406,093 is equipped with a liner for the mechanical removal of debris. In addition to requiring frequent attention for the extraction of debris, the design does not address the problem of entrapment of small grits and seeds, a single large piece of debris partially blocking the flow creating a settling basin for small particles. The Good design becomes partially dis-functional, the extent of dis-functionality being functions of the debris rate and how often the debris is mechanically extracted.

The designs of Briggs and Duffy both feature curved covers having slopes equal to, but no less than the roof pitch, a desirable attribute inasmuch as the cover is no more a hindrance to the discharge of debris from the roof than the higher-coefficient-of-friction asphalt waterproofing materials most commonly used. However, both are used in conjuction with gutters having traditionally wide bottom dimensions that are conducive to settling-out the smaller debris that is not rejected by the curved covers by virtue of the much higher surface-tension-to-mass of the smaller debris.

SUMMARY OF THE INVENTION

The purpose of this invention is to provide a system that will separate larger debris from water at the edge of inclined roofs; sending the larger debris to the ground and the water with the macroscopic particles, via gutters, to downspouts. The design of this invention, herein referred to simply as the gutter system for brevity, is directed toward elimination of most of the maintenance normally associated with conventional gutters, even those with some type of cover. Further to provide such a system that integrates well with present inclined roofs, is functionally efficient, pleasing architecturally, and easy to install. Further, a gutter system that resists damage ordinarily caused when a ladder is placed against it.

In its simplest form, the gutter system consists of a half cylinder whose major axis is parallel to, and is situated just under, the edge of the inclined roof. The half cylinder is attached to the fascia board or any part of the vertical portion of the eaves with the convex side out and the diameter fastened against the eaves. In operation, the water flows down the front of the half cylinder, adhering to its surface by molecular attraction. Attached just below the half cylinder is a trough having a cross-section, that is flat for ½ inch of its width at the bottom, with a cross sectional area that increases exponentially from the bottom to approximately 3 inches at the top of the cross section.

In operation, the leaves, pine needles, sticks, and other debris ride down the roof hydraulically and onto the convex surface of the half cylinder. The debris, because of its lower surface tension and relative stiffness, is unable to negotiate the curved surface and falls to the ground. The rainwater separates from the smooth convex cylinder only when gravity becomes dominant over surface tension as the water flows around and underneath the surface. The gutter is so positioned, and the curvature of the semi-cylinder so selected, that the combination captures approximately 99 percent of the water while rejecting approximately 99 percent of the debris. The gutter is only ½ inch wide at its base so that the flow of water is confined to a small planar area in order to inhibit settling of particulates especially during light rainfalls. The cross sectional area is increased exponentially, however, from bottom to top of the gutter in order to accommodate the flow of increasingly heavier rains.

The gutter system is less prone to damage when a ladder is leaned against it, the half cylinder being able to withstand much higher bearing loads than an open trough because of the way the system is configured with greater support; and such that the Hertzian contact stress between ladder side-rails and system is much less by virtue of the much greater radius of curvature of the gutter system in the ladder-contact region compared to most of the other designs.

The gutter system requires minimum interference with existing roof systems, other inventions often require the insertion of a flange beneath shingles and fasteners through the shingles.

DESCRIPTION OF THE PREFERRED EMBODIMENTS

Figure 1:
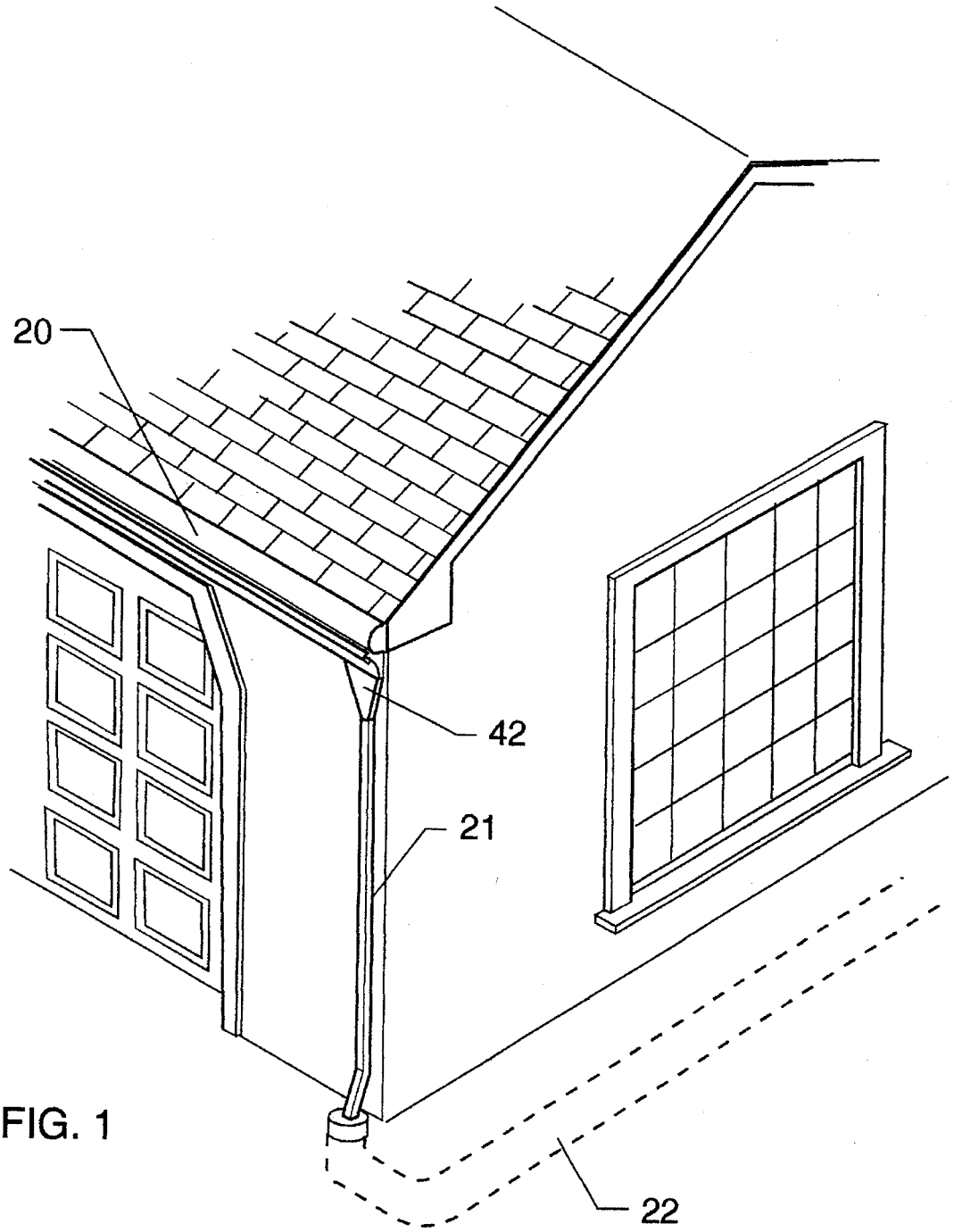
FIG. 1 is an isometric view of a house with a Discriminator Rain Gutter System of this invention showing the roof lines and relative location of elements.

Referring first to FIG. 1, the half cylinder and exponential gutter assembly is generally shown as 20 with downspout 21 and ground drain 22. Transition section 44 connects the half cylinder and exponential gutter assembly 20 to downspout 21.

Figure 2:
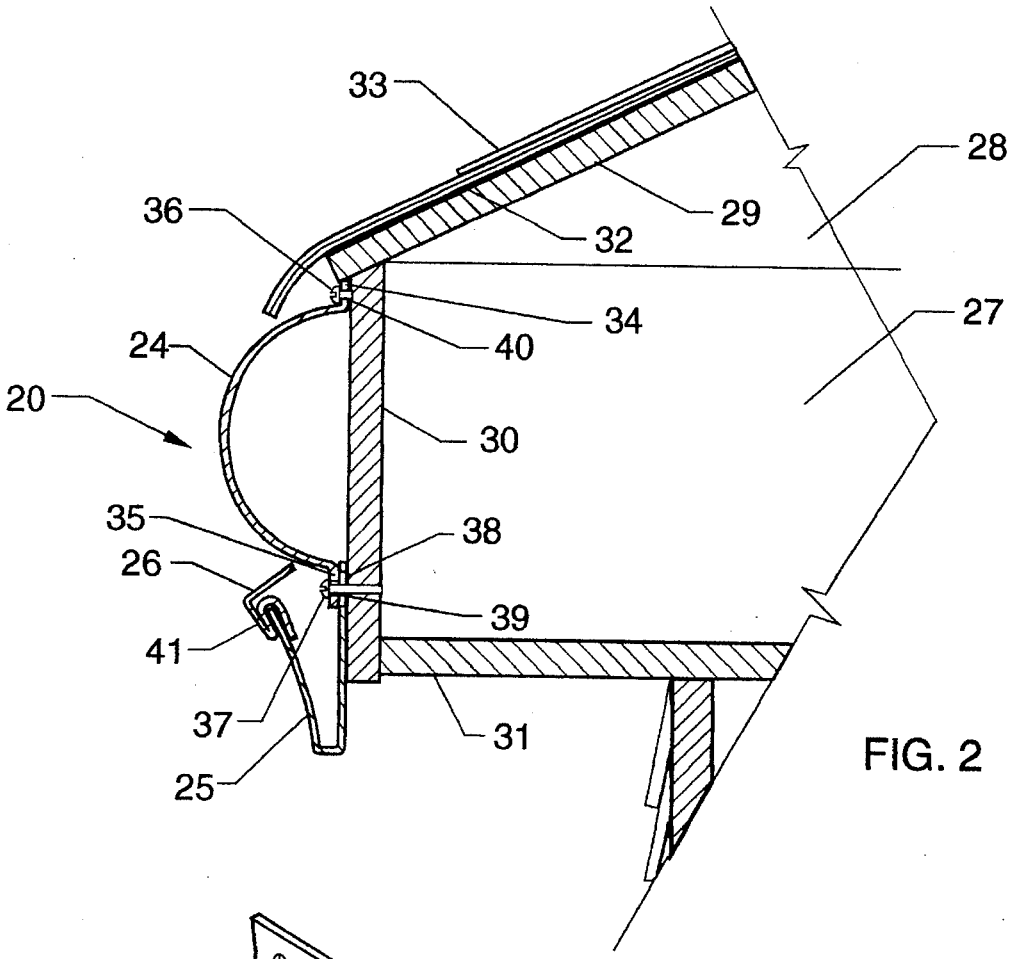
FIG. 2 is a cross-sectional view of the half cylinder and exponential gutter assembly.

Referring to FIG. 2, a half cylinder 24 and exponential gutter 25 with debris fence 26 are shown as they would be installed on a typical inclined roof structure 10. The building construction includes ceiling joists 27 attached to rafters 28.

A decking 29, usually plywood, is affixed to the rafters 28. The ends of the vertically cut ceiling joists 27 and rafters 28 are closed out with a fascia board 30. The underside of the overhanging portion of the rafters 27 is closed out with a soffit board 31.

The decking 29 is covered with a felt 32 and shingles 33. Typically the last row of shingles 33 are allowed to overhang the decking. This overhang can be varied but is typically approximately 1 inch. The most commonly used shingles 33, due to their inherent tendency to creep under heat and load, tend to curve downward after installation.

Figure 3:
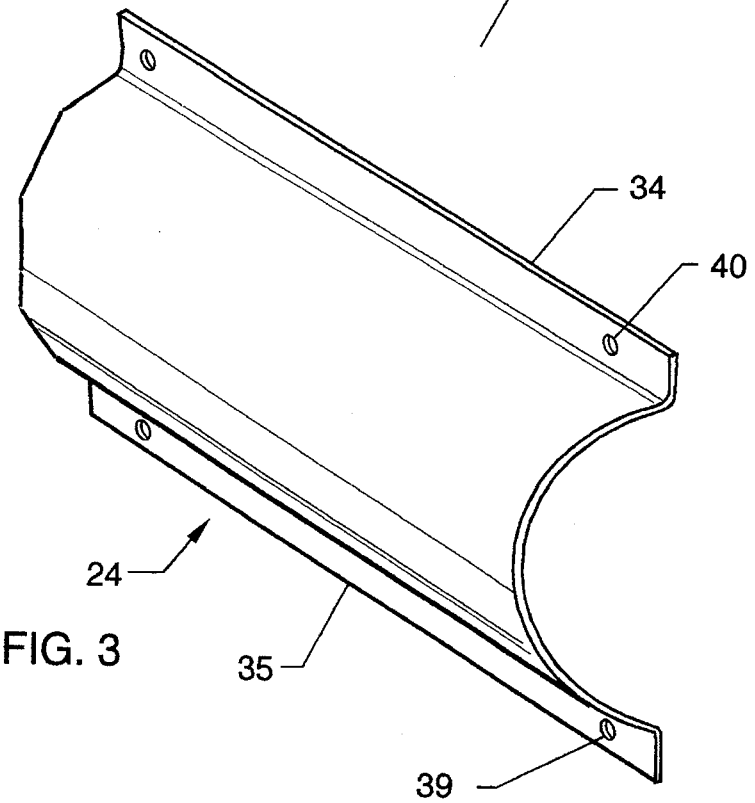
FIG. 3 shows an isometric view of the half cylinder with flanges.
Figure 4:
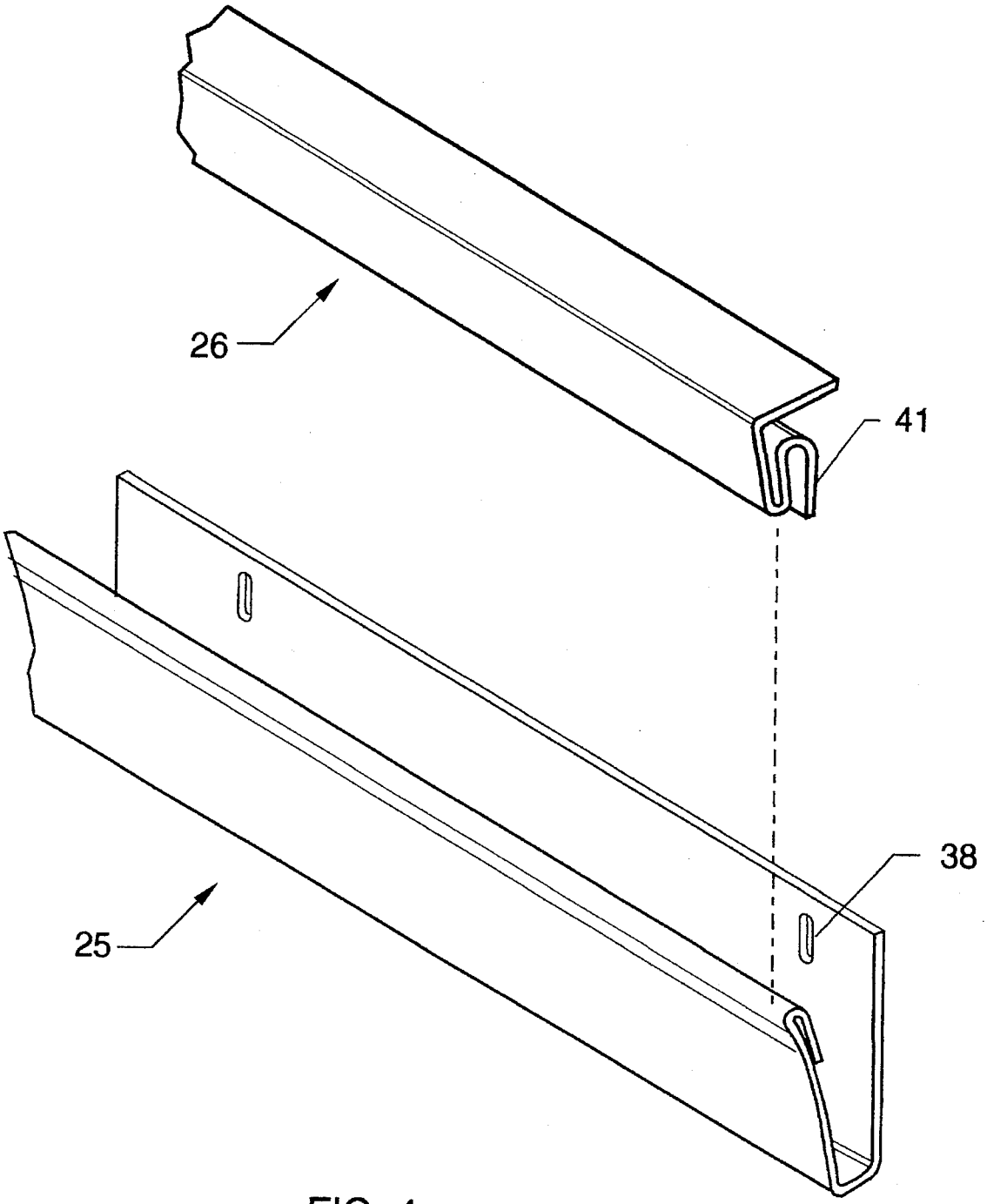
FIG. 4 shows the removable debris fence in an exploded view with the exponential rain gutter.

The half cylinder 24 and exponential gutter 25, both of this invention, are affixed to the vertical face of the fascia board 30. The upper flange 34 of the half cylinder is placed abut the underside of decking 29 and is affixed to the fascia board 30 using upper fasteners 36. The rear vertical surface of the exponential gutter 25 is inserted behind the lower flange 35 of the half cylinder 24. Referring to FIGS. 3 and 4, included for added clarity, equally spaced vertical slots 38 located in the upper-back of the exponential gutter 25 are aligned with equally spaced holes 39 in the lower flange 35 of the half cylinder. Lower fasteners 37 are inserted, but before being fully tightened, the exponential gutter 25 is adjusted to provide a gradient to the specified downspout using vertical displacement afforded by the vertical slots 38 in exponential gutter 25.

To facilitate installation, adjustment, or removal of the half cylinder and exponential gutter, the debris fence 26, shown in exploded view in FIG. 4, can be removed from, or attached to, the exponential gutter 25 by virtue of the rolled joint 41 extensively used in the sheet metal trades industries to lock two components together.

Figure 5:
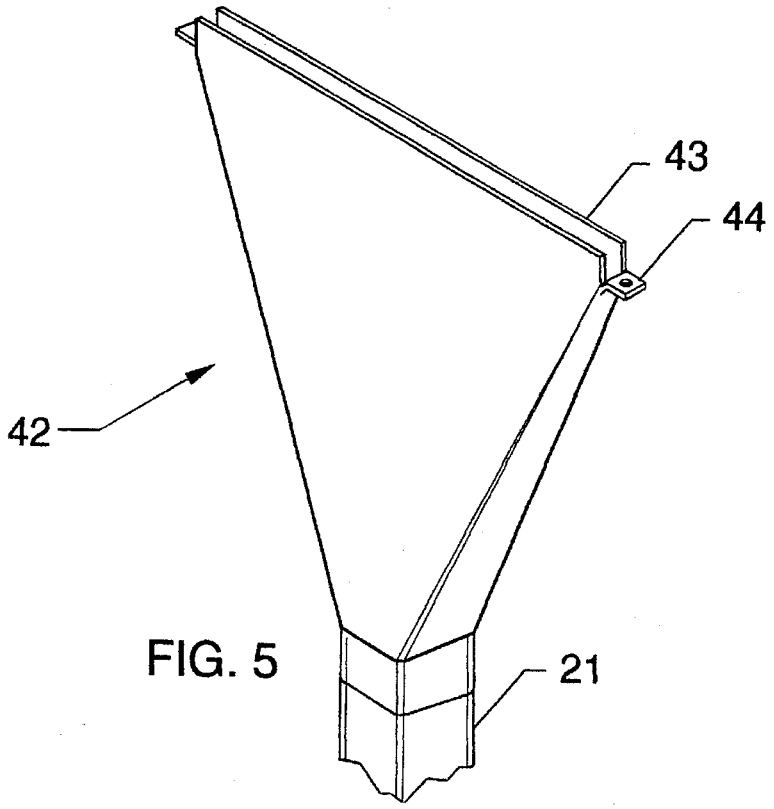
FIG. 5 shows the gutter-to-downspout transition section.

To accommodate the flow from the exponential gutter 25 to downspout 21, a transition section 42 of the shape shown in FIG. 5 is used. The top flanges 43 of the transition section are spaced so that they just fit into a slot machined in the bottom of the exponential gutter 25, a slot having a width just equal to the interior width of the bottom of the gutter. Tabs shown 44 are provided as a surface through which rivets can be installed to attach the transition section 42 to exponential gutter 25. A sealant is used to prevent leakage between exponential gutter 25 and transition section 42.

Figure 6:
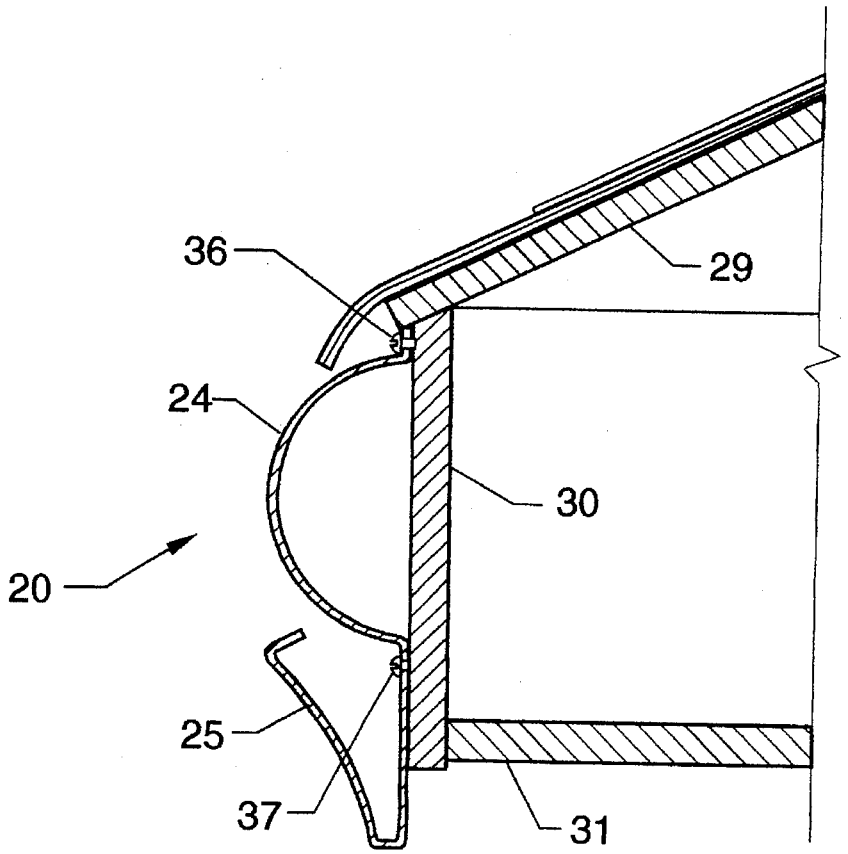
FIG. 6 shows a one piece alternate embodiment of the invention.

In an alternate embodiment shown in FIG. 6, the half cylinder 24 and the exponential gutter 25 with gutter debris fence 26 can be formed in one piece 20. To obtain gradient, in this embodiment, the upper fasteners 36 are secured with the upper flange of the half cylinder abut the lower surface of the decking 29. The lower fasteners 37 are then installed starting with a point most distant from the downspout for that section, and progressively installed while an increasing amount of pressure is applied to the half cylinder in a direction normal to the plane of the fascia board 30. This applied pressure increases the radius of curvature of the half cylinder 24 slightly and correspondingly the vertical distance between the upper and lower holes 39 and 40 in FIG. 3, thus forcing the exponential gutter section increasingly downward in the direction of the downspout giving a gradient for the flow of water. The installation of the lower fasteners 37 of this embodiment involves the elastic deformation of the outer edge of the exponential gutter 25 outward and downward in order to access the equally spaced lower holes 39 for the installation of the lower fasteners 37. One method of manufacture for this embodiment would be by means of extrusion of a polymer. The material would have a lower modulus than a gutter system made, for example, of aluminum or steel.

The half cylinder and exponential gutter assembly could be manufactured in one piece by the extrusion of aluminum. Because of the somewhat higher modulus of the aluminum than the plastic, the lower fastener 37 of FIG. 6 would be inserted and driven into the fascia board 30 at an angle formed by an imaginery line between the lower fastener 37 and the center of the aperture made between the debris fence 26 and the half cylinder 24. Also, the gradient for the extruded aluminum embodiment of this invention would be obtained by installing the half cylinder with exponential gutter 20 at an angle starting with the upper flange 34 of the half abut with the decking as the highest point in the gradient with increasing space between upper flange 34 and decking 29 in the direction of the downspout 21.

For all embodiments, the fascia board 30 can be eliminated and the half cylinder 24 fastened directly to the vertically cut ends of the rafters 28 or ceiling joists 27 providing pitch and location of slots 38, and upper holes 39 and lower holes 40 match the locations on ceiling joists 27 or rafters 28. A screen is installed in each end of the half cylinder 24 making the component serve also as an attic ventilation duct eliminating the need for ventilator grills often placed in cut-outs in the soffit 31.

As suggested above, several materials and methods of manufacture are available in the production of rain gutter system of this invention. Materials that can be used include aluminum, galvanized steel, and plastic. Methods of manufacture include continuous roll-forming and extrusion.

I claim:

1. A gutter assembly adapted to be attached to a fascia board located below a building roof, said gutter assembly comprising: a half-cylinder including an upper flange and a lower flange, each of said flanges extending radially outward from said half-cylinder and generally defining a single plane, said flanges adapted to be attached to said fascia board; a gutter defining a fluid receiving trough having a modified channel shape and being adapted to be mounted immediately below and adjacent to said half-cylinder on said fascia board such that fluid flowing off said building roof is directed over and around the half-cylinder and into said gutter.

2. A gutter assembly according to claim 1 wherein said gutter modified channel shape has a bottom width, a top width and a height defining a cross-sectional area wherein the cross-sectional area increases exponentially from said bottom width to said top width, wherein the ratio of the bottom width to the top width is approximately 1 to 4, and the ratio of the bottom width to the height is approximately 1 to 7.

3. The gutter assembly of claim 1 wherein said upper flange and said lower flange include apertures for receiving fasteners, said gutter including an upper back flange which has apertures adapted to align with the apertures of the lower flange of said half-cylinder such that upon installation of said gutter assembly on said fascia board, fasteners are passed through the apertures of the upper flange of the half-cylinder, and fasteners are passed through the apertures of the lower flange of the half-cylinder which are placed in alignment with the apertures of the upper back flange of the gutter.

4. The gutter assembly of claim 1 wherein said gutter is provided with a removable strip which comprises an inclined lip for rejection of debris and for decorative enhancement of the gutter assembly.

5. The gutter assembly of claim 1 further including fasteners for attaching said half-cylinder and said gutter to said fascia board, said fasteners being selected from the group comprising wood fasteners and sheet metal fasteners.

* * * * *